US006925760B2

(12) United States Patent
Suprina

(10) Patent No.: US 6,925,760 B2
(45) Date of Patent: Aug. 9, 2005

(54) STACKABLE MODULAR ARENA SEATING

(76) Inventor: Scott Suprina, 26 Parkway Dr. South, Commack, NY (US) 11725

( * ) Notice: Subject to any disclaimer, the term of this patent is extended or adjusted under 35 U.S.C. 154(b) by 50 days.

(21) Appl. No.: 10/226,682

(22) Filed: Aug. 26, 2002

(65) Prior Publication Data

US 2003/0200703 A1 Oct. 30, 2003

Related U.S. Application Data

(60) Provisional application No. 60/375,284, filed on Apr. 24, 2002.

(51) Int. Cl.[7] ..... E04H 3/12

(52) U.S. Cl. ..... 52/9; 52/64; 297/235; 297/236; 182/69.6

(58) Field of Search ..... 52/6, 7, 8, 9, 10, 52/64, 592.5, 592.6; 211/49.1, 189, 194

(56) References Cited

U.S. PATENT DOCUMENTS

| | | | | | |
|---|---|---|---|---|---|
| 2,801,752 | A | * | 8/1957 | Jakubowski | 211/49.1 |
| 3,443,835 | A | | 5/1969 | Brunskole | |
| 3,808,757 | A | | 5/1974 | Greenwood | |
| 3,945,497 | A | * | 3/1976 | Greenberg | 211/70 |
| 4,039,132 | A | * | 8/1977 | Fournier | 248/150 |
| 4,102,087 | A | * | 7/1978 | Jarvis | 52/9 |
| 4,345,406 | A | * | 8/1982 | Motley | 52/8 |
| 4,379,378 | A | * | 4/1983 | McMahan | 52/9 |
| 4,412,403 | A | | 11/1983 | LeFranc et al. | |
| 4,831,797 | A | | 5/1989 | Vladikovic | |
| 5,016,765 | A | * | 5/1991 | Leonardo | 211/189 |
| 5,385,323 | A | | 1/1995 | Garelick | |
| 5,678,706 | A | * | 10/1997 | Husak et al. | 211/189 |
| 5,960,589 | A | | 10/1999 | Youngquist et al. | |
| 6,000,174 | A | * | 12/1999 | Yamazaki | 52/9 |
| 6,044,990 | A | * | 4/2000 | Palmeri | 211/189 |
| 6,244,657 | B1 | | 6/2001 | Momose | |
| 6,257,427 | B1 | * | 7/2001 | Schneid | 211/189 |
| 6,484,450 | B1 | * | 11/2002 | Suprina et al. | 52/8 |
| 6,502,708 | B2 | * | 1/2003 | Daniel | 211/189 |
| 6,574,923 | B1 | * | 6/2003 | Johnsson et al. | 52/8 |
| 2003/0200703 | A1 | * | 10/2003 | Suprina | 52/9 |

FOREIGN PATENT DOCUMENTS

| | | | |
|---|---|---|---|
| GB | 2229089 A | 9/1990 | A47C/3/04 |
| GB | 2229205 A | 9/1990 | E04H/3/12 |
| GB | 2229217 A | 9/1990 | F16B/21/16 |

* cited by examiner

*Primary Examiner*—Carl D. Friedman
*Assistant Examiner*—Yvonne M. Horton
(74) *Attorney, Agent, or Firm*—Alfred M. Walker

(57) ABSTRACT

Stackable modular arena seating risers include permanently attached high quality fold down seats that are the equal of normal arena seats. Stacking of the riser modules is facilitated by the use of quick lock stacking tubes fit into locator cups permanently attached into each corner of the deck of each module. Fork lifting channels of the proper size and spacing are provided on three sides of each module to facilitate movement of the entire stack and the stacking, unstacking, and movement of individual modules.

20 Claims, 6 Drawing Sheets

STACKABLE MODULAR ARENA SEATING

This application claims the benefit of Provisional Application No. 60/375,284, filed Apr. 24, 2002.

FIELD OF THE INVENTION

The present invention relates to stackable, modular arena seating risers, with permanently installed fold down seats.

BACKGROUND OF THE INVENTION

Often an arena is used for multiple sports events with different seating configurations and/or capacities. For example, hockey games and basketball may be played in the same facility. Rectangular basketball courts are considerably smaller than hockey ice playing rinks. So when the ice and protective transparent shields of hockey rinks are removed, the arenas conventionally install temporary risers with adjacent folding chairs joined together at their lower legs. Regardless of the type of cushioning, the seats are fairly uncomfortable, as they are little more than padded "bridge" chairs.

OBJECTS OF THE INVENTION

It is therefore an object of the present invention to provide an arena seating module with comfortable courtside or rinkside seats.

It is also an object of the present invention to provide a stackable modular seating module which utilizes fold-down seats and which promotes versatility.

It is yet another object of the present invention to provide modular riser components with chairs which are permanently affixed.

It is also an object to provide a fork liftable seating module to maximize relocatability and speed of installation and removal.

It is still another object of the present invention to quickly convert a hockey rink arena to a basketball court arena.

Other objects which become apparent from the following description of the present invention.

SUMMARY OF THE INVENTION

In keeping with these objects and others which may become apparent, the present invention includes a system of stackable, modular arena seating risers, with permanently installed fold down seats.

The present invention provides stackable modular arena seating risers with permanently attached high quality fold down seats that are the equal of normal arena seats. Stackable unibody all aluminum welded frames and seat supports are used. Framing members are typically 2" by 2" structural alloy tube with a wall thickness of ⅛". Typically two or three modules are stacked, and each modular riser section would be a minimum of two rows four seats wide. Stacking of the riser modules is facilitated by the use of quick lock stacking tubes fit into locator cups permanently welded into each corner of the deck of each module. Fork lifting channels of the proper size and spacing are provided on three sides of each module to facilitate movement of the entire stack and, more importantly, the stacking, unstacking, and movement of individual modules.

When viewed from the side, each module includes two or three rows of seats on separate risers, forming a triangle in crossection. Each modular section is joined by stacking support rod legs insertable in locking locator cups. These support rod legs are preferably polygonal, such as square or rectangular, with distinct corners not present in smooth cylindrical rods, so that the installer can visually see if they are secured properly in place within the respective locking cups. If these rods are rotated out of place, they won't be properly positioned in place.

When viewed from the top, the riser frames of each seating module each have two side beams joined to front and rear beams, and these front and rear beams are preferably joined by a further structural beam in the center, although other configurations are possible. The beams are covered by plywood floors coated with non-slip resins, thus forming the deck to which the chairs are fastened.

After the seats of the stackable seating module are folded down, they are ready for transport to storage out of the way during a hockey game with a larger playing area than that of a basketball court. To transport the stackable seating modules, hollow receptacle channels are provided in one or more sides for insertion of the forks of lifting fork lifts. Preferably the hollow receptacle channels are provided in at least three sides, namely the two sides and the rear, or possibly also in the front, but that means the weight with the higher portion of the riser is at the rear opposite end.

The stackable seating module units include the novel features of having a stackable unibody frame component with quick lock stacking support rod legs and non-slip decking floors.

While other seats may be used, permanently installable fold-down chairs are used, such as sold under the trade name of "IRWIN brand knockdown chairs", to match arena seats in the permanently installed seating sections of the arena. Aisle center handrails are provided to code, based on height, and end frame rails are provided to code based on height. Each seating module includes riser closure cover plates. The handrails, frame rails and cover plates are preferably aluminum, because of its durability and light weight.

The stackable unibody frames include welded frame and seat supports, wherein the groups of seats are preferably provided in modules of two or three rows of seats. Seat support channels are configured and welded in place at all appropriate contact points between the support channels and the base frame, to maximize rigidity. The fork-liftable receptacle channels, made of lightweight materials such as aluminum and the like, are provided as recesses which are designed spaced apart from each other and are located to allow lifting from a minimum of three sides of the stackable seating module.

Locator cups are provided in the corners of each deck for holding the vertically oriented stacking support leg rods, which separate adjacent stacked seating modules. Preferably the locator cups are permanently welded into each corner of the deck, to allow quick placement of the quick lock stacking rod legs for storage. These locator cups preferably include a locking cap to prevent debris from entering the interior sockets when not in use.

Each quick lock stacking support rod leg is preferably a structural member, with a bottom machined insert designed to twist lock into the corner cups on the seating riser deck, to allow for stacking of the seating modules. The top machined insert does not need to be lockable, but it can be. Since these quick lock support rod legs must clearly show locked and unlocked position at a visual glance to maximize safety, they are preferably square or rectangular in crossection. When the guide lock support rod legs are removed for stacking of the modules, they are stored concealed under each seating module unit when not in use.

The floor decking is sized as needed to minimize module design and maximize portability. The decking is preferably a ½" thick anti-slip resin faced plywood. These deck units, when installed on their structural framing, have no exposed corners. All edges are preferably completely concealed by aluminum edge covers riveted with ¼ inch huck rivets on 6 inch centers to prevent deck damage.

The fold-down chairs, such as IRWIN brand chairs, are provided for placement in the balance of the arena when the larger hockey rink is replaced by a smaller basketball court. They are constructed with a quick knock down pivot assembly that allows the chairs to tilt down forward, decreasing their respective heights, which therefore allows a minimal stacking vertical size for the entire seating module. Seat units are ganged to fit the seating modules with preferably a minimum of four chairs in width in two or three rows. These units are delivered to the arena site completely assembled ready for placement.

Each seating module is provided with handrails and end frame rails, which are preferably of two inch anodized aluminum rails. Vertical pickets are utilized to ensure compliance with four inch sphere criteria and to eliminate climbing.

All riser areas are completely closed with aluminum plates to eliminate pass through of debris and concealed deck edges to eliminate damage.

The stackable seating modules are fabricated with live load 120 PSF gross horizontal, with permitted lateral sway load of 24 PLF per section. Perpendicular sway load 6 preferably 10 PLF, and guardrail load is preferably 100 PLF vertical and 50 PLF horizontal.

For stability, all foot plank deck surfaces are designed to deflect less than ¼ inch under the design load on a single module. To maximize leveling from unit to unit in field, adjustments are made by welding glide shims to frame bottoms.

The seating modules of the present invention enhance the interchangeability of arenas having hockey rinks and basketball courts by incorporating stackable seating modules which have permanently installed fold-down stadium arena seats, which greatly enhances the versatility of the arenas.

The use of quick locking connectors to the seating modules provides the seating modules with portability and maximum use of the arena with permanent comfortable seating.

The important stacking function of the seating modules is maintained. The synergistic combination of the stackable seating modules with the unique permanent fold-down seats provide beneficial effects that are not possible with any other type of arena seating.

Therefore, the modular seating includes a frame having a right and left side portions, as well as a top portion with a plurality of risers on the top portion, with a plurality of locator cups on each of the risers. The frame also includes a bottom portion with a plurality of locator cups on the bottom portion placed opposite to each locator cup in the plurality of riser locator cups. A polygonal support leg interlocks in each of the support cups. A row of foldable seat posts are mounted to each riser in the set of risers and a seat is mounted to each of seat post. Each seat includes a seat frame with a folding guide plate, a cushion, and a foldable, preferably cushioned backrest. Each frame further has protective panels covering the left and right portions wherein the respective protective panels have fork lift tubes disposed therein. Each of the riser locator cups have an insert with one or more integral locking pins. The stackable seating system of the present invention is achieved by providing one or more self-supporting seating section riser modules and moving the self-supporting seating sections into an enclosed entertainment area. Each seat is alternatively unfolded and folded in the self-supporting riser modules, which are moved in the respective self-supporting seating sections outside the enclosed entertainment area, while the leg tubes are interlocked in each locator cup located on each self-supporting riser module. Fork lifts are used to relocate the self-supporting riser modules. Subsequent seating modules are placed in respective leg tubes wherein these leg tubes are partially disposed within the locator cups located on a bottom portion of the subsequent riser modules.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
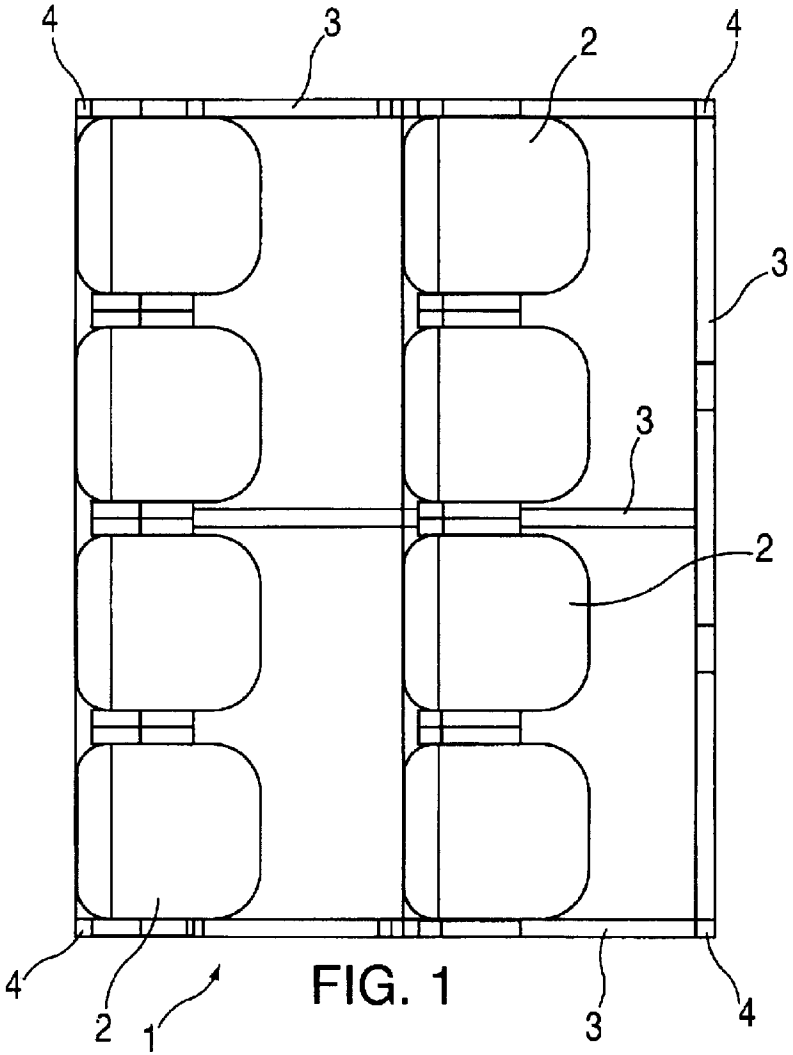
FIG. 1 is a top plan view of a stack of seating modules of the present invention.

FIG. 1 shows a top view of stack 1 of riser modules showing welded frame members 3 and a configuration of two rows with four chairs 2 in the open position. Locator cups 4 are shown in the corners.

Figure 2:
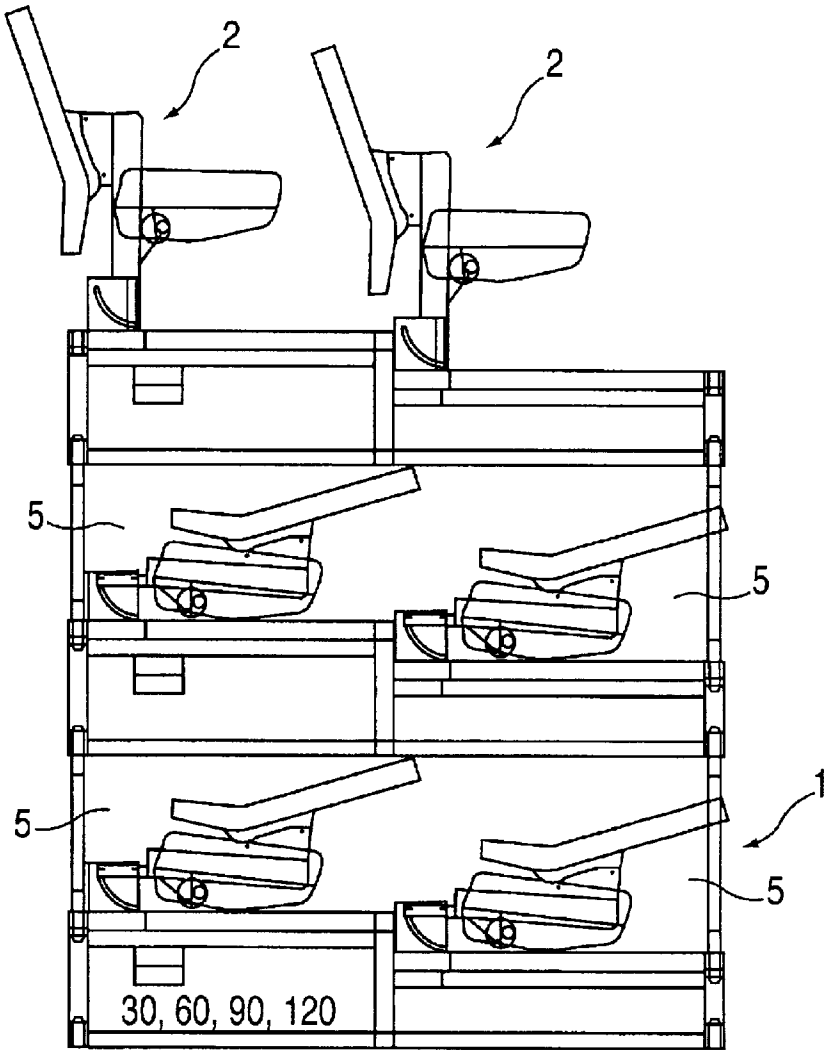
FIG. 2 is a side elevational view of the stack of seating modules of FIG. 1.

A side view (to the same scale) is shown in FIG. 2. Three riser modules are shown in stack 1 with the top module having open chairs 2 and the lower two modules having folded chairs 5. Of course, for compact storage, top chairs 2 would be folded as shown 5 in the lower two modules.

Figure 3A:
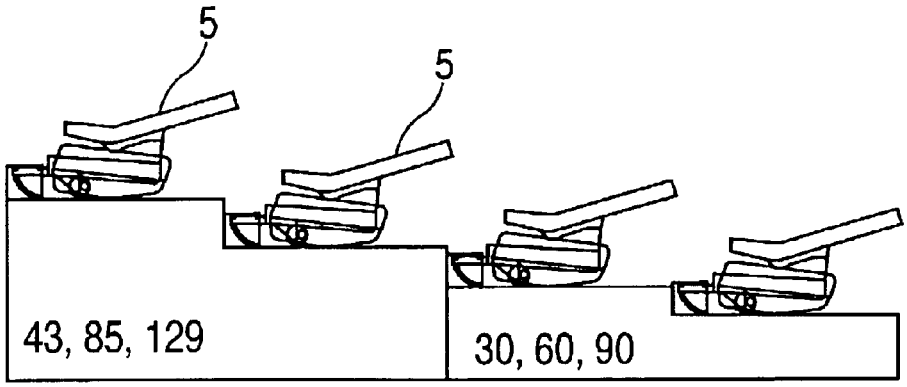
FIGS. 3A–3C are side elevational views of a variety of module configurations when unstacked with folded chairs.

FIG. 3A shows a configuration of two different stackable riser modules with folded chairs 5.

Figure 3B:
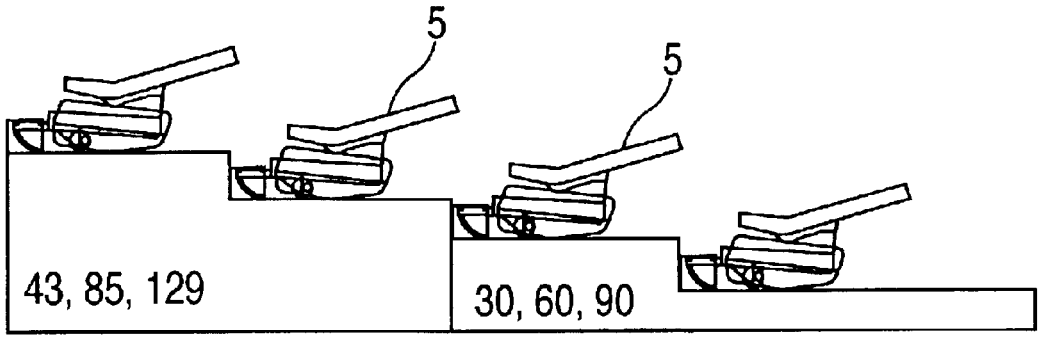

FIG. 3B shows a different front module, with folded seats 5, wherein the module has a wide front deck or aisle.

Figure 3C:
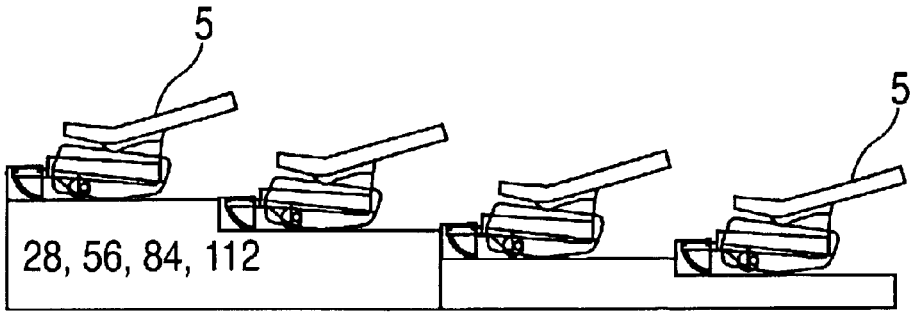

FIG. 3C shows a module with four rows of folded chairs 5.

Figure 4A:
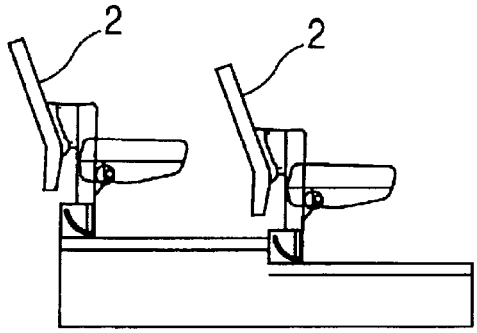
FIGS. 4A–4D are side elevational views of a variety of module configurations when unstacked, showing unfolded chairs.
Figure 4B:
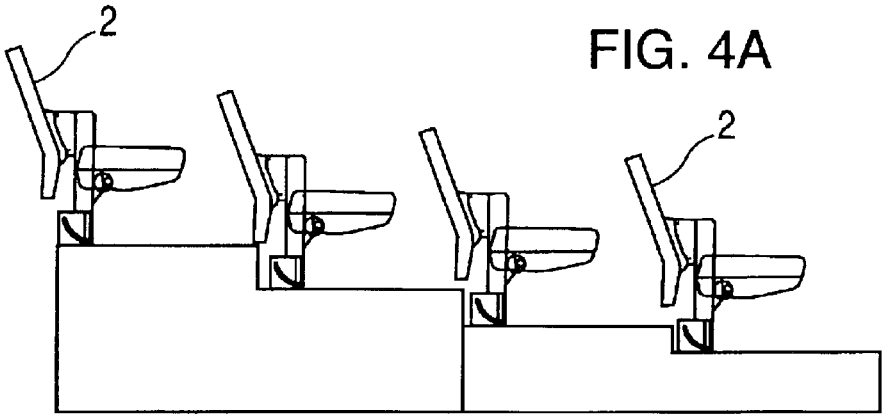
Figure 4C:
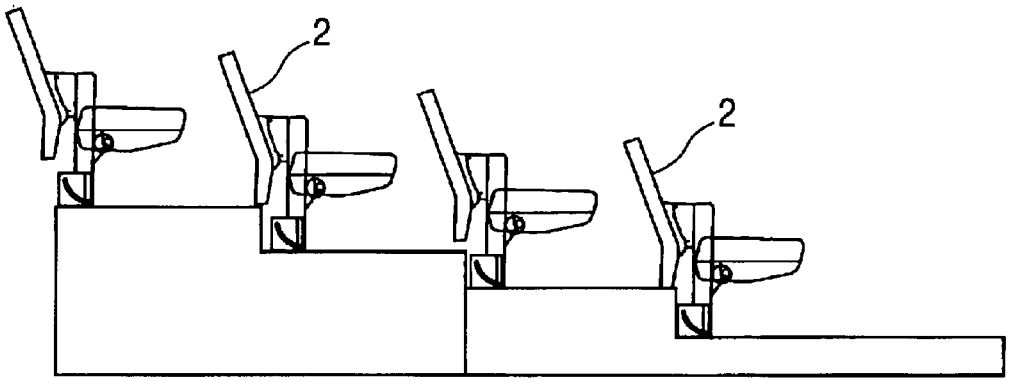
Figure 4D:
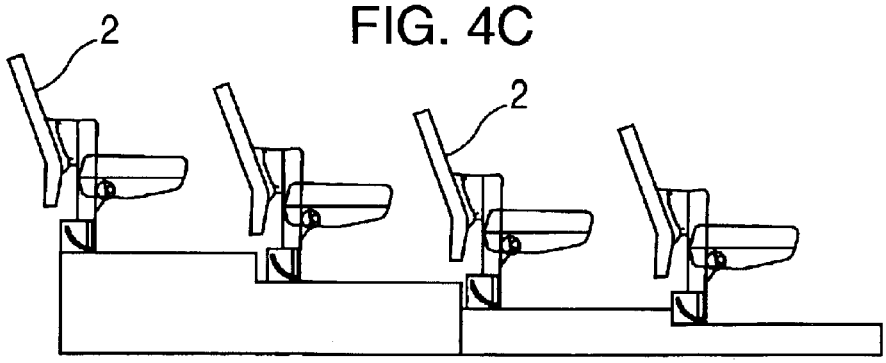

The views of FIGS. 4B, 4C, and 4D show modules corresponding to those of FIGS. 3A–3C, but with the chairs 2 unfolded. FIG. 4A shows just a single two row module of chairs 2.

Figure 5:
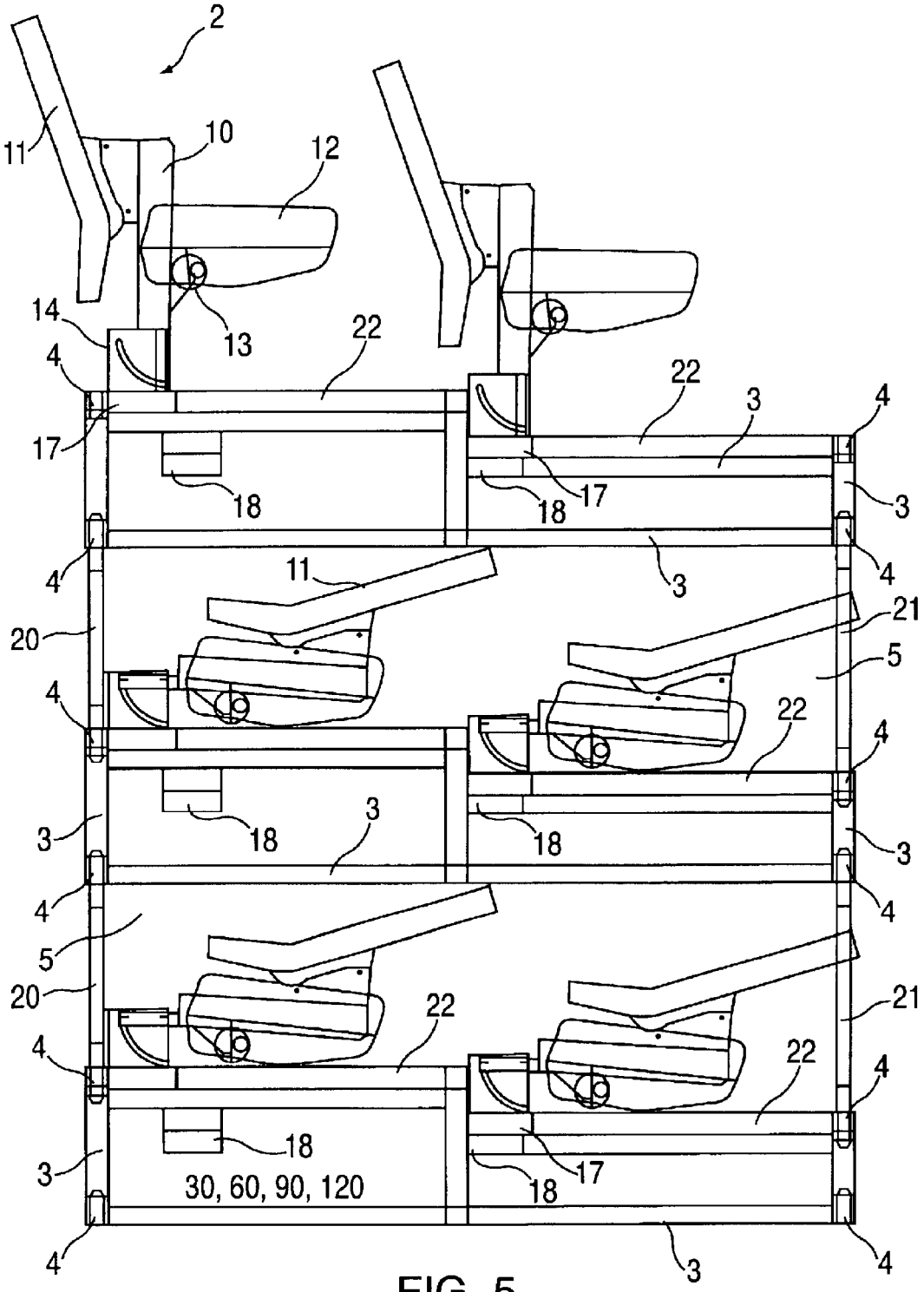
FIG. 5 is an enlarged side elevational view of a stack of three seating modules.

FIG. 5 shows a side view of a stack of three riser modules in more detail. Short stack support legs, such as tubes 20 and long stack support legs, such as tubes 21, are shown engaged in locator cups 4. While these tubes are preferably hollow, it is known that solid rods can also be used. Decking 22 is shown atop frame members 3. Each chair 2 or 5 has seat cushion 12 with cushion folding mechanism 13, seat frame 10 with folding guide plate 14, and seat back 11. Welded seat support members 17 and pairs of equally spaced fork lift tubes 18 are also visible.

Figure 6:
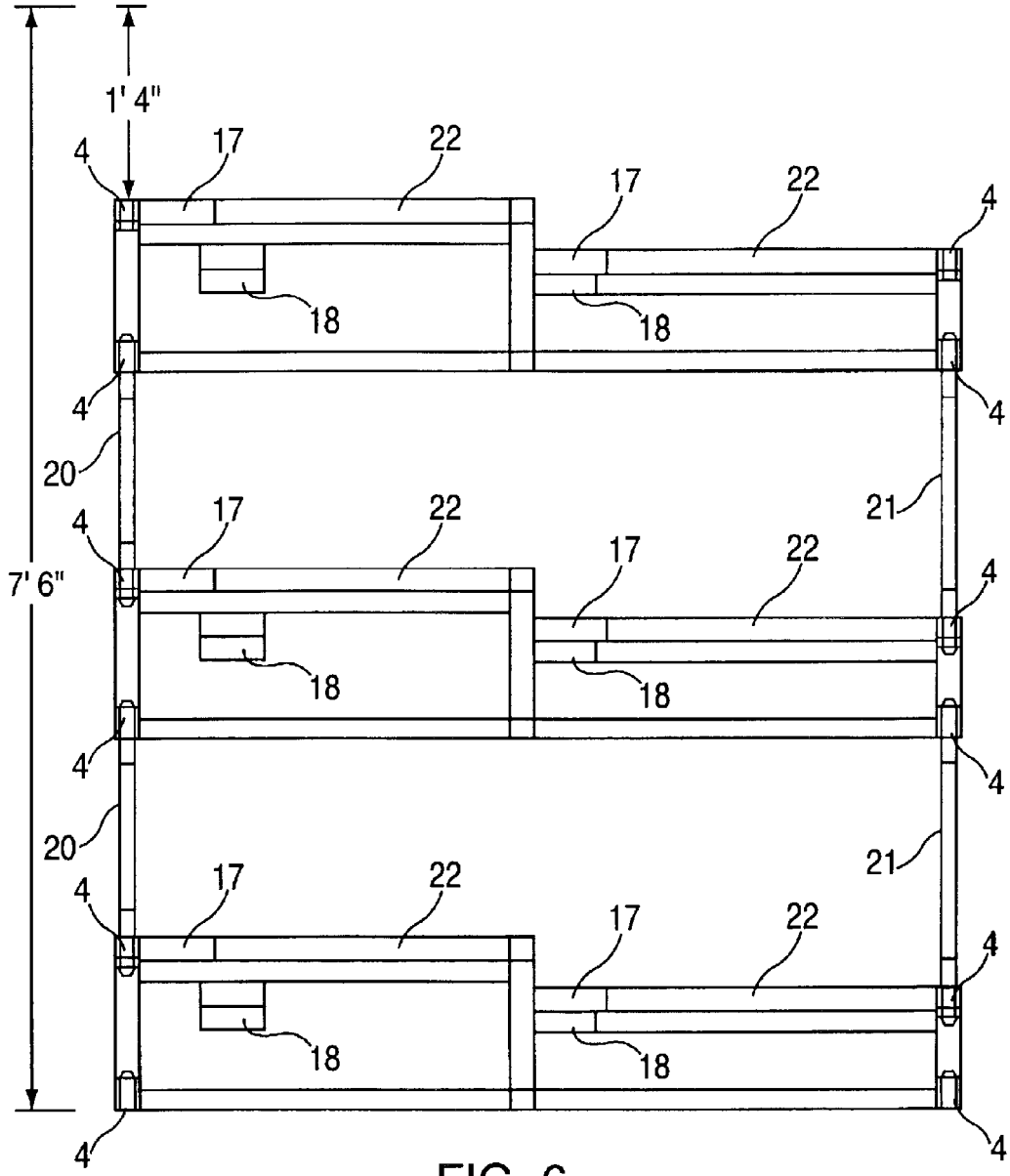
FIG. 6 is a side elevational view of the frame and stacking legs of a three seating module stack.

FIG. 6 shows the side view of FIG. 5 without the clutter of chairs 2 and 5. It also gives some concrete idea of the size of a stack showing an overall stack height of 7'6" (2.3 m) with top chairs folded. Each folded chair 5 only requires 1'4" (41 cm) clearance. Locator cups have lockable covers (not shown) which prevent debris from finding its way inside on the top facing surfaces when unstacked and in use. Also, modules have aluminum sides installed to prevent injury and to prevent debris from entering the area under the risers.

Figure 7:
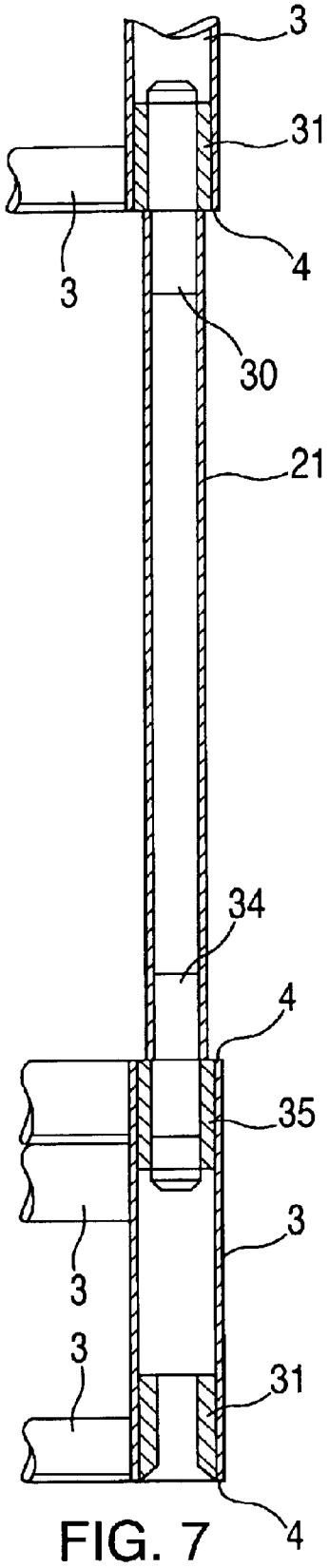
FIG. 7 is a crossectional side detail view of stacking legs and locator cups; and, FIG. 8 is a top plan view detail of the locking mechanism for a stacking leg inside a locator cup.
Figure 8:
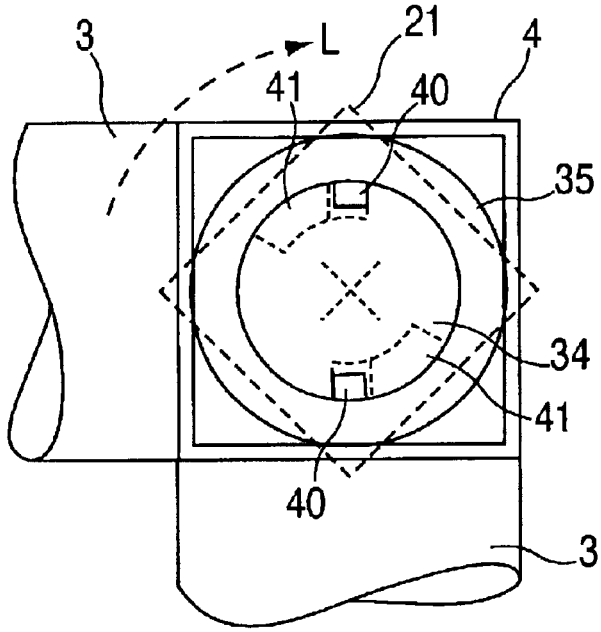

FIGS. 7 and 8 describe operation of quick lock tubes 21 and locator cups 4. Bottom facing locator cups 4 have a plain welded insert 31 whereas top facing locator cups 4 have welded insert 35 with two integral locking pins 40 protruding from their inner diameter. Quick lock support leg tube 20 or 21 has plain welded insert 30 at the top end and locking welded insert 34 with channels 41 that engage pins 40 and lock into inserts 35 in locator cups 4. Since quick lock support leg tubes are polygonal, such as square, in crossection, a non-locked support leg tube is easy to spot since it will be misaligned with the corner of locator cup 4. Quick lock support leg tubes 20 or 21 only lock at their bottom ends; in this way, a module above is simply lifted on or off the plain end and is located by plain insert 31 in locator cup 4. The locking motion is simply a twist in the indicated direction "L". When unlocked and removed from an unstacked module, quick lock support leg tubes 20 or 21 are stored in a concealed area under each module.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

I claim:

1. Modular seating comprising:

a frame having a top portion and a bottom portion, a plurality of locator cups on said top portion, and on said bottom portion; and a polygonal stacking support leg interlockable in each of locator cups;

a deck mounted to said top portion of said frame; and, a plurality of foldable seats mounted to said deck.

2. The modular seating of claim 1 wherein each said support leg is hollow.

3. The modular seating of claim 1 wherein each support leg has a rectangular cross-section.

4. The modular seating of claim 1 wherein said frame is made of aluminum.

5. The modular seating of claim 1 wherein said frame further comprises:

protective panels wherein said protective panels have fork lift tubes disposed therein.

6. The modular seating of claim 1 wherein said support leg have a square cross-section.

7. The modular seating of claim 1 wherein said locator cups have covers.

8. The modular seating of claim 1 wherein each of said locator cups have an insert with at least one integral locking pin.

9. A method of altering a seating arrangement comprising the steps of:

providing at least one self-supporting seating section riser module;

moving said at least one self-supporting seating section into an enclosed entertainment area;

unfolding each seat in said at least one self-supporting riser module;

folding each said seat in said at least one self-supporting riser module;

moving said at least one self-supporting seating section outside said enclosed entertainment area; and interlocking leg tubes in each locator cup located on said at least one self-supporting riser module.

10. The method according to claim 9 wherein the moving steps further comprise:

using a fork-lift to relocate said at least one self-supporting riser module.

11. The method according to claim 10 further comprising:

placing a second riser module in said at least one self-supporting user module on said log tubes wherein said leg tubes are partially disposed within locator cups located on a bottom portion of said second riser module.

12. The method according to claim 11 said placing of said second riser module further comprises:

using a fork-lift to relocate said second riser module onto said leg tubes.

13. A modular riser comprising:

a deck having a top and a bottom wherein said top and bottom have corners;

a plurality of locator cups on respective top and bottom portions of said deck; and, a plurality of support legs, each said support leg separating said deck from an adjacent deck; and, a plurality of folded seats mounted to said deck.

14. The modular riser of claim 13, wherein each locator cup in said plurality of locator cups is located in each corner of said top and each corner of said bottom.

15. The modular riser of claim 13, wherein each locator cup has a locking cap.

16. The modular riser of claim 13, wherein each said support leg comprises a polygonal support leg in each locator cup of said top.

17. The modular riser of claim 16, wherein said polygonal support legs have a rectangular cross-section.

18. The modular riser of claim 16, wherein said polygonal support legs have a square cross-section.

19. The modular riser of claim 16 wherein each of said locator cups have an insect with at least one integral locking pin.

20. The modular riser of claim 16 wherein said locator cups have covers.

* * * * *